US007278688B1

(12) United States Patent
Hung

(10) Patent No.: US 7,278,688 B1
(45) Date of Patent: Oct. 9, 2007

(54) ELASTIC SUPPORT STRUCTURE FOR A HUMAN BODY TO LEAN AGAINST

(76) Inventor: Hsiang-Lin Hung, 6F., No. 6, Lane 43, Siouci St., Beitun District, Taichung City (TW)

( * ) Notice: Subject to any disclaimer, the term of this patent is extended or adjusted under 35 U.S.C. 154(b) by 0 days.

(21) Appl. No.: 11/538,510

(22) Filed: Oct. 4, 2006

(51) Int. Cl.
*A47C 7/44* (2006.01)

(52) U.S. Cl. ..... 297/354.11; 297/285; 297/404; 297/314

(58) Field of Classification Search ..... 297/285, 297/291, 353, 354.1, 354.11, 411.35, 411.38, 297/314, 404
See application file for complete search history.

(56) References Cited

U.S. PATENT DOCUMENTS 2,524,624 A * 10/1950 Cramer ..... 297/291
2,529,683 A * 11/1950 Fox ..... 297/291
3,121,592 A * 2/1964 Anderson ..... 297/284.1
4,135,836 A * 1/1979 Rensland et al. ..... 403/120
4,316,632 A * 2/1982 Brauning ..... 297/291
6,116,687 A * 9/2000 Vogtherr ..... 297/300.1
6,305,747 B1 * 10/2001 Mei ..... 297/354.11
6,322,145 B1 * 11/2001 Melgarejo et al. ..... 297/354.11
6,523,895 B1 * 2/2003 Vogtherr ..... 297/300.1
7,000,987 B2 * 2/2006 Staarink ..... 297/284.7
2001/0054836 A1 * 12/2001 Vik ..... 297/284.8

* cited by examiner

*Primary Examiner*—Peter R. Brown
(74) *Attorney, Agent, or Firm*—Egbert Law Offices

(57) ABSTRACT

The elastic support structure for human body to lean against includes a connecting frame, a swing rack, and an elastic rod. The connecting frame includes a connecting surface and a positioning part for the support structure. The swing rack has its first end placed on one end of the connecting frame, which makes the second end of the swing rack swing. At least two elastic rods are placed on the same side of the connecting frame and swing rack, and two movable parts of the support structure. A multi-directional swing is created. The movable part of the support structure uses the swing feature of the second end of the swing rack, so that the movable part creates a greater range of swing in the corresponding direction.

4 Claims, 9 Drawing Sheets

ELASTIC SUPPORT STRUCTURE FOR A HUMAN BODY TO LEAN AGAINST

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a support structure for a human body to lean against, and more particularly to a structure with an elastic support.

2. Description of Related Art Including Information Disclosed Under 37 CFR 1.97 and 37 CFR 1.98

A chair is a common support structure for a human body to lean against, and the parts of the chair, that offer support, include the back of chair, seat, pillow, and armrest. The parts can have a surface covered with a soft sponge layer, so that it is not too stiff and uncomfortable when leaning against it. Since the main chair structure is positioned firmly, the sponge layer on parts of the chair are not completely rigid when the human body is in the seated position. For instance, the human back and head usually move a little, and the pressure between the human thigh and seat varies depending upon the size of the body. Discomfort can occur when the human arm is placed on the armrest for a certain period of time. Therefore, a conventional chair causes discomfort because of its main structure being positioned so firmly. For this reason, the industry has created some features that allow certain parts of chair to be elastic. In the common structure, the elastic structure of the chair is usually applied on the back of the chair and is generally achieved by torsion springs. Because the orientation of this elastic structure is fixed, the degree of softness felt by user is poor.

Another common structure is an elastic structure made of an elastic rod. This structure can be elastic in all directions, so that the supporting part with the elastic structure has the flexibility of leaning in different directions. The elastic support of this elastic structure is made of multiple elastic rods placed in a cris-cross pattern, so that there is consistent elasticity in all directions. However, in terms of the supporting part of the chair, the directional flexibility must fit the human figure, such as the rate of moving back and forth being greater than the rate of moving left to right. Therefore, the elastic rod fails to meet this demand adequately, and it is necessary to create a new structure.

Thus, to overcome the aforementioned problems of the prior art, it would be an advancement in the art to provide an improved structure that can significantly improve efficacy.

To this end, the inventor has provided the present invention of practicability after deliberate design and evaluation based on years of experience in the production, development and design of related products.

BRIEF SUMMARY OF THE INVENTION

In addition to creating a multi-directional swing in the present invention, the elastic support structure A of the present invention is the movable part 12 of the support structure for human body to lean against 10, such as a chair. The elastic support structure A uses the swinging feature of the second end 32 of the swing rack 30, so that the movable part 12 of the support structure for human body to lean against 10 creates a greater range of swing in the corresponding direction. The elastic support structure A meets the requirement for use of the support structure for human body to lean against.

The structure has swing rack 30 and/or connecting frame 20 with spaced holes 34, so that the elastic rod 42 can be placed in any set of the holes 34. By so doing, the distance between these two sets of the elastic rods 41, 42 is adjusted, and adjusting the distance to change the range of the swing meets different demands.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
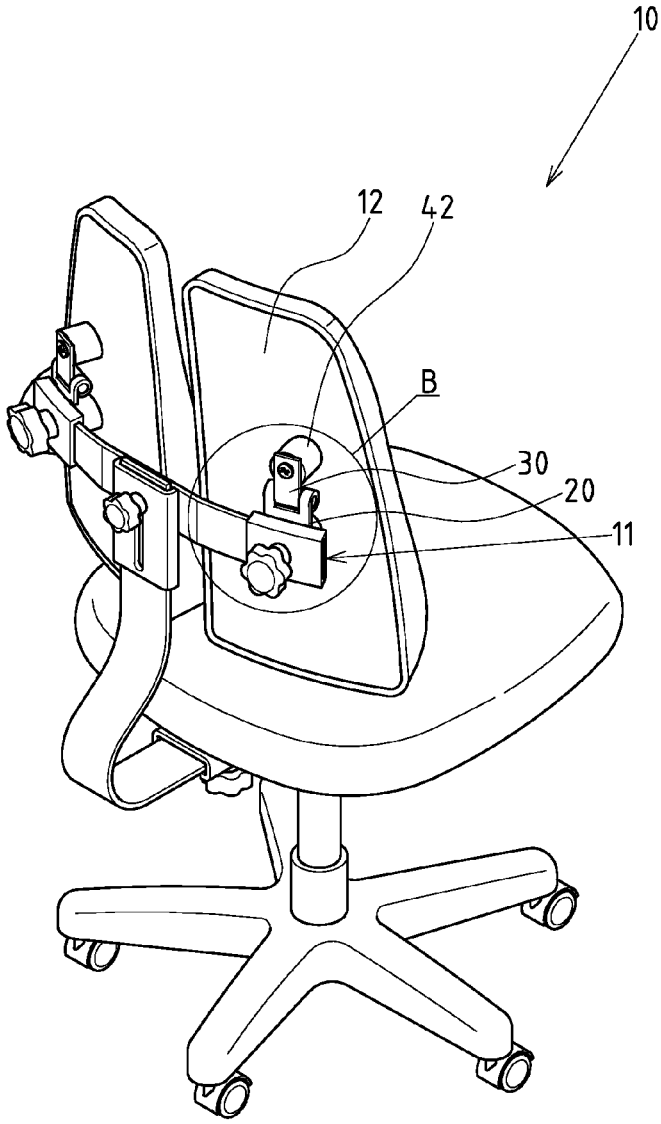
FIG. 1 shows a perspective view of the first application of the support structure for human body to lean against of the present invention.
Figure 2:
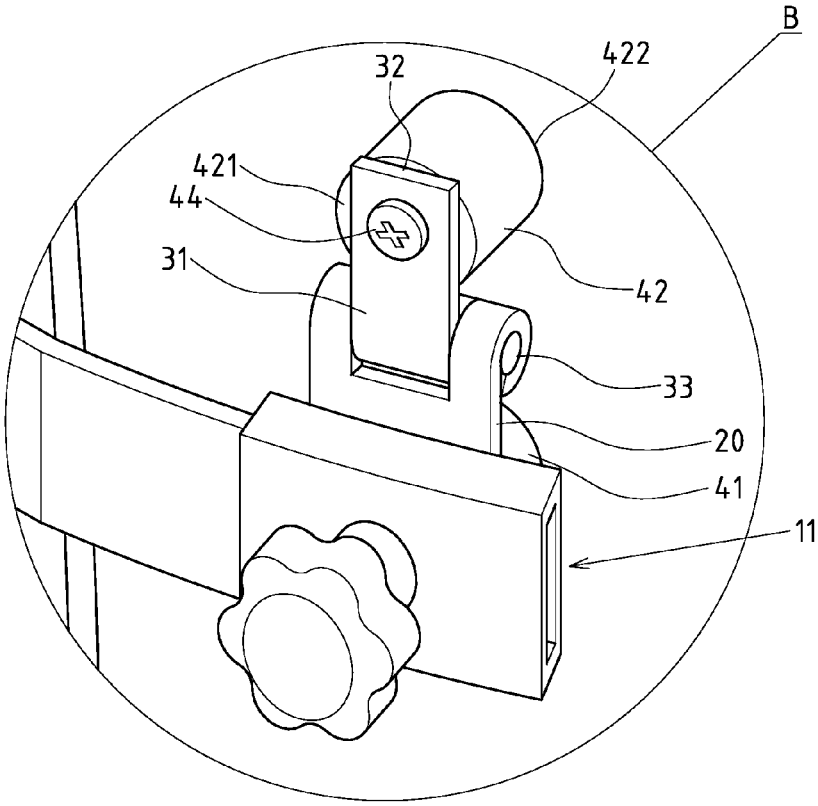
FIG. 2 shows an enlarged and isolated partial perspective view of part B of FIG. 1.

The features and the advantages of the present invention will be more readily understood upon a thoughtful deliberation of the following detailed description of a preferred embodiment of the present invention with reference to the accompanying drawings.

As shown in FIGS. 1-4, a support structure for a human body to lean against is embodied in the present invention. This embodiment is for descriptive purposes only. The present invention is not limited to this exact embodiment. The elastic support structure A is placed between the positioning part 11 and movable part 12 of the support structure for a human body to lean against 10, so that the movable part 12 can create elastic movement. The support structure 10 of the present invention is a chair, and the positioning part 11 and the movable part 12 can be separate parts of the chair, as shown in FIGS. 1-4. The movable part 12 is the back of the chair, and the positioning part 11 is a vertical supporting rod of the chair. Other embodiment shall be described later.

The elastic support structure A comprises a connecting frame 20, which is a plate, and the connecting frame 20 has a connecting surface 21 and a positioning part 11 connected to the support structure 10. The connection between the connecting surface 21 and the positioning part 11 is not limited, such that the connection can include screws, welding, and riveting.

A swing rack 30 can be a plate, and its first end 31 is placed on one end of the connecting frame 20, which makes the second end of the swing rack 30 swing. The first end 31 of the swing rack 30 can be placed on the connecting frame 20 by a bolt axle 33, so that the second end 32 of the swing rack 30 swings based on the bolt axle 33 as a rotating point.

Figure 3:
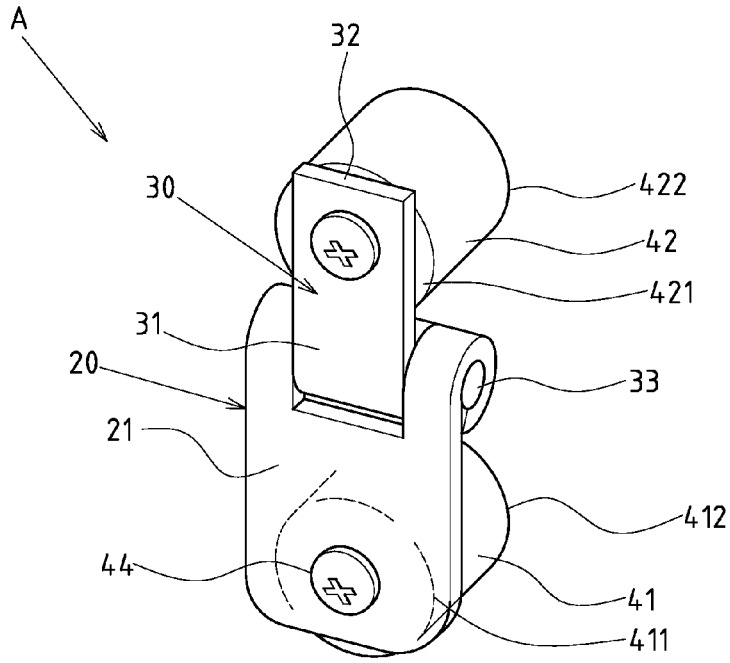
FIG. 3 shows a perspective view of the preferred embodiment of the elastic support structure of the present invention.
Figure 4:
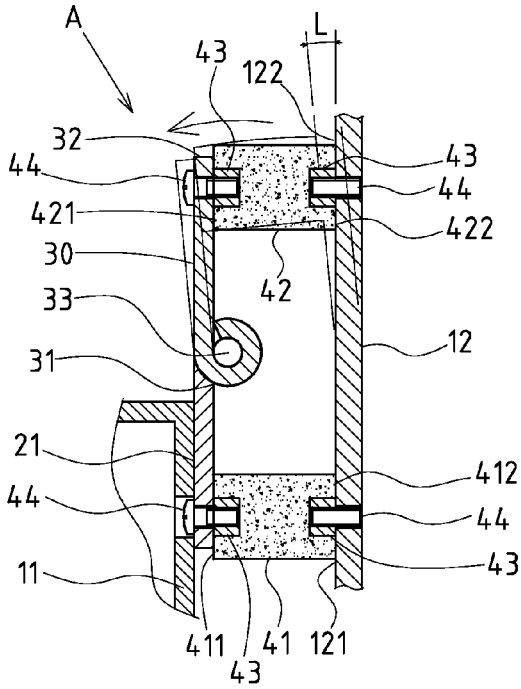
FIG. 4 shows a sectional view of the preferred embodiment of the elastic support structure of the present invention.

At least two elastic rods 41, 42, as shown in FIGS. 3, 4, and the first end 411 of the first elastic rod 41 are placed on one side of the connecting frame 20. The second end 412 of the first elastic rod 41 is connected to the first connecting part 121 of the movable part 12 of the support structure 10. The first end 421 of the second elastic rod 42 is placed on one side of the second end 32 of the swing rack 30, in the same direction with the first elastic rod 41. The second end 422 of the second elastic rod 42 is connected to the first connecting part 122 of the movable part 12 of the support structure for human body to lean against 10.

The connecting method of the elastic rods 41, 42, is shown in FIG. 4. The screw base 43 is placed on the first end 411, 421, and the second end 412, 422 of the elastic rods 41 42, the elastic rods 41, 42, the connecting frame 20, swing rack 30, and the movable part 12 are positioned through the screw bolt 44.

Through the above structures, the operation of the elastic support structure A disclosed by the present invention is explained as shown in FIG. 4. A multi-directional swing is created. The movable part 12 of the support structure 10 uses the swinging feature of the second end 32 of the swing rack 30, so that the movable part 12 of the support structure 10 creates a greater range of swing (marked L as shown in FIG. 4) in the corresponding direction. In terms of the movable part 12 being the back of the chair, the advantage is that, when the human body is leaning against the chair, if its back moves naturally, most of time, it moves back and forth. Therefore, the swinging feature of the second end 32 of the swing rack 30 accommodates this habit.

Figure 5:
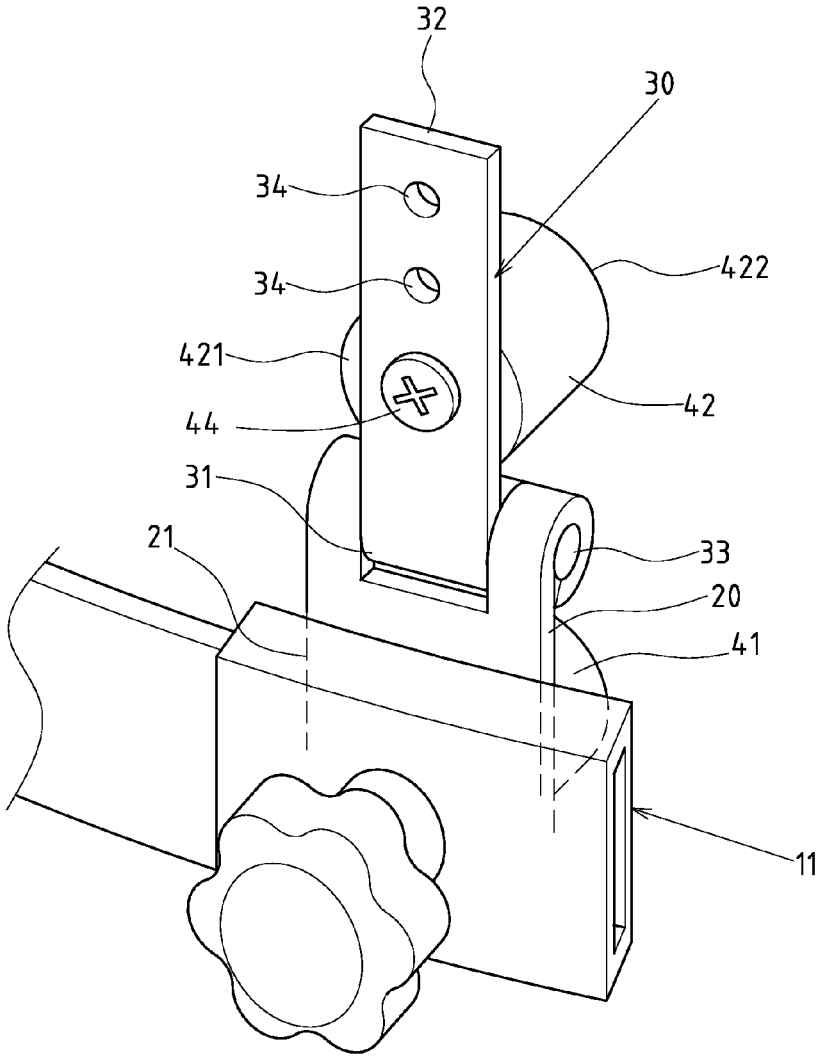
FIG. 5 shows an enlarged and isolated partial perspective view of an embodiment of the swing rack of present invention with multiple sets of holes.

As shown in FIG. 5, the swing rack 30 and/or the connecting frame 20 can have several spaced holes 34, so that the elastic rod 42 can be placed in any set of hole 34. By so doing, the distance between the two sets of elastic rod 41, 42, is adjusted, and adjusting the distance to change the range of the swing meets different demands.

Figure 6:
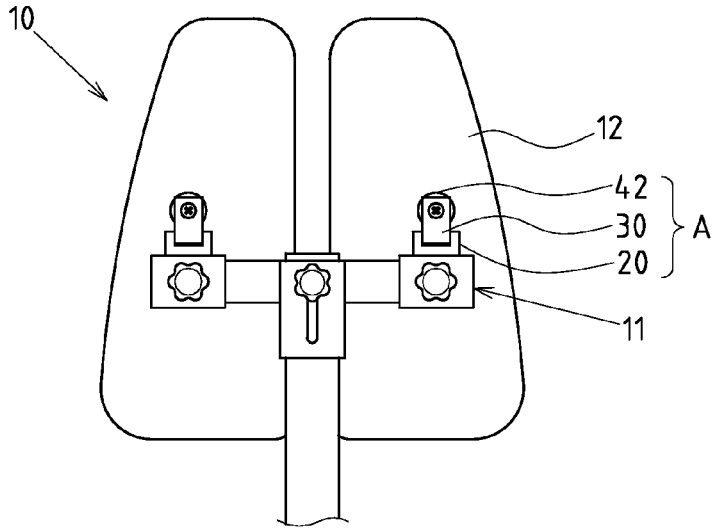
FIG. 6 shows a rear elevation view of the back of the chair of the present invention being two pieces.
Figure 7:
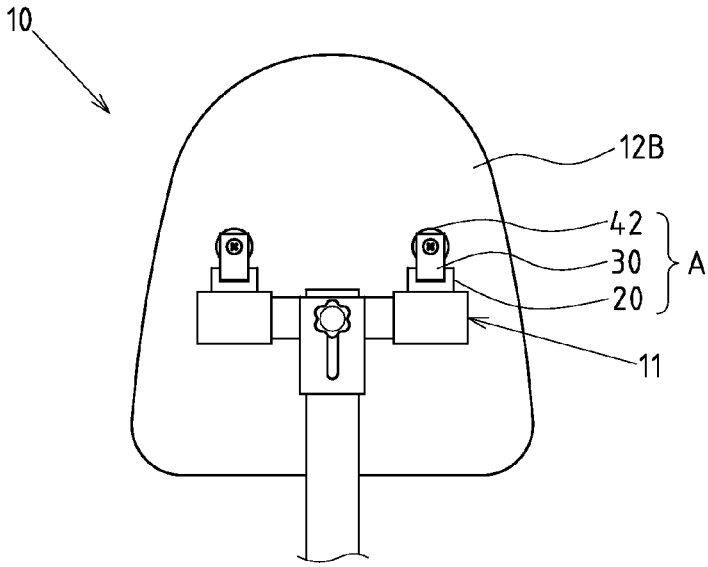
FIG. 7 shows a rear elevation view of the back of the chair of the present invention being a single piece.

As shown in FIG. 6, when the movable part 12 is the back of the chair, it can be a two-piece adjustable back. Alternatively, the movable part 12B shown in FIG. 7 shows that it can be a single piece chair back.

Figure 8:
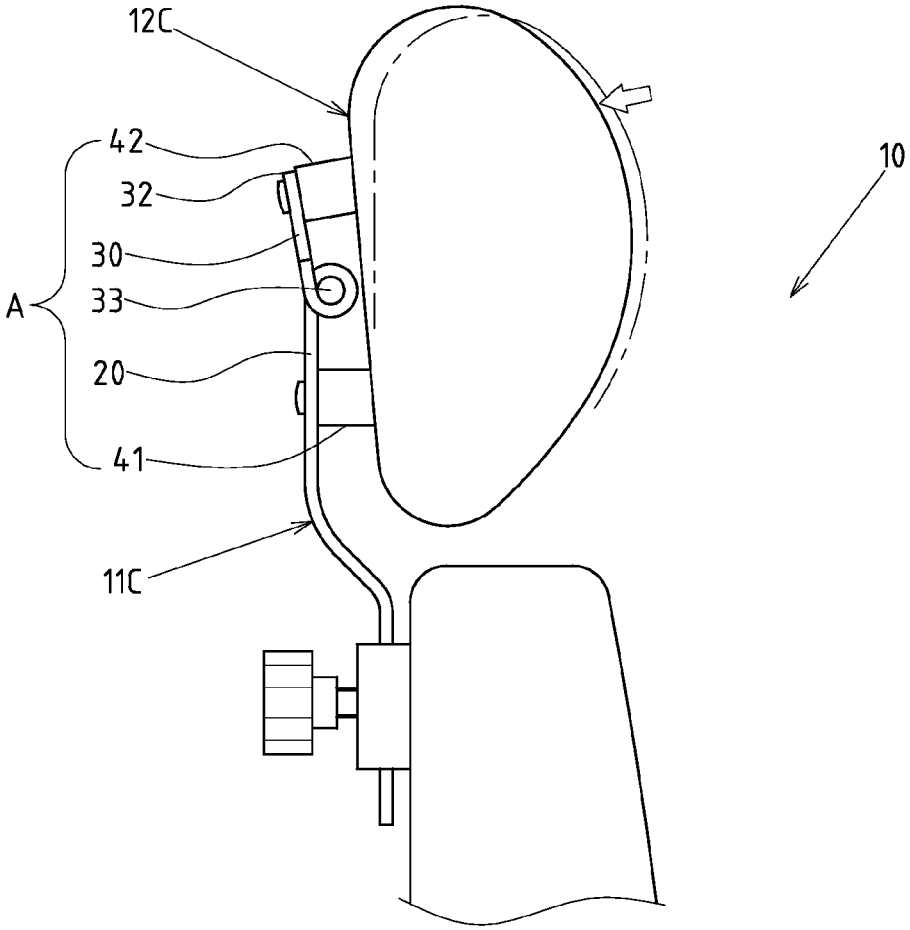
FIG. 8 shows a side elevation view of the pillow of the chair of the present invention being the movable part.

The following describes the positioning part and movable part applied in the other parts of a chair. As shown in FIG. 8, the movable part 12C can be the pillow part of the chair, and the positioning part 11C can be used as supporting frame for movable part 12C. This embodiment uses the swinging feature of the second end 32 of the swing rack 30 to create a greater range of swing (in the direction marked by hollow arrow in FIG. 8) in the corresponding direction, so that it meets the need for a human head when leaning backwards.

Figure 9:
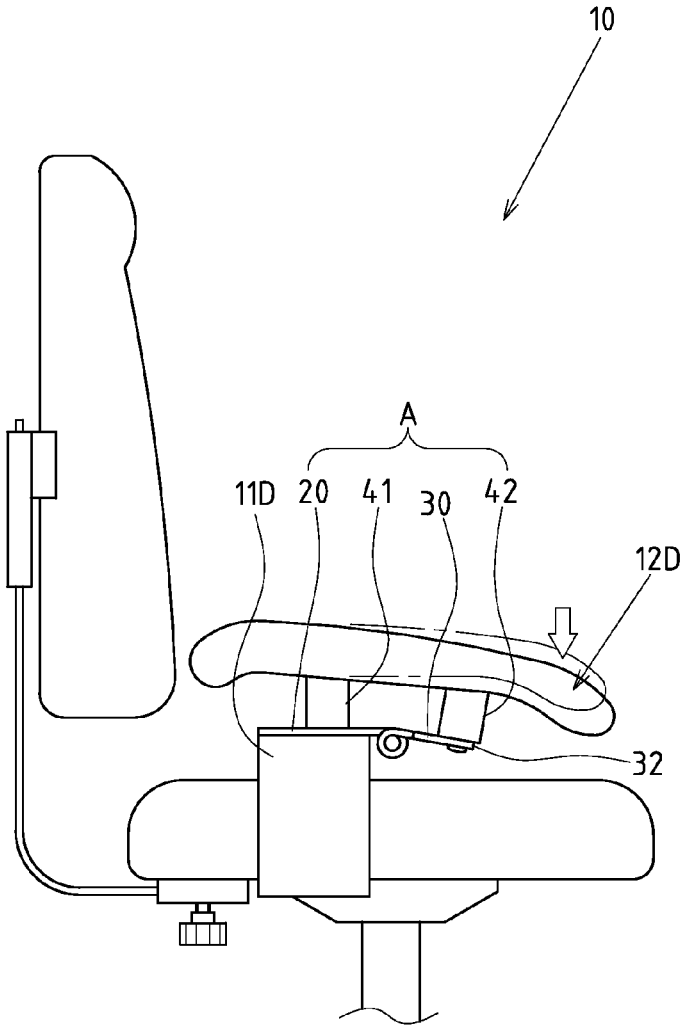
FIG. 9 shows a side elevation view of the arm of the chair of the present invention being a movable part.

As shown in FIG. 9, when the movable part 12D is the armrest of the chair, the positioning part 11D is used as supporting frame for movable part 12C. This embodiment uses the swinging feature of the second end 32 of the swing rack 30 of the elastic support structure A to create a greater range of swing (in the direction marked by hollow arrow in FIG. 9) in the corresponding direction, so that it meets the need for human elbow when it pushes down.

Figure 10:
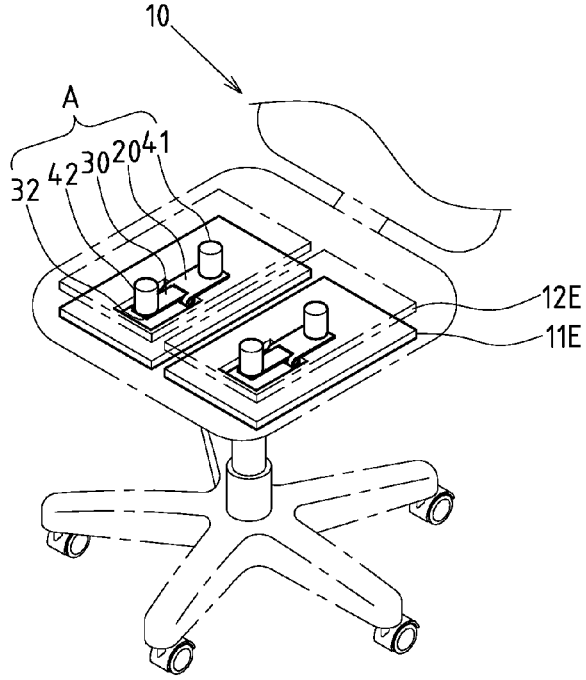
FIG. 10 shows an upper perspective view of the seat of the chair of the present invention being a movable part.
Figure 11:
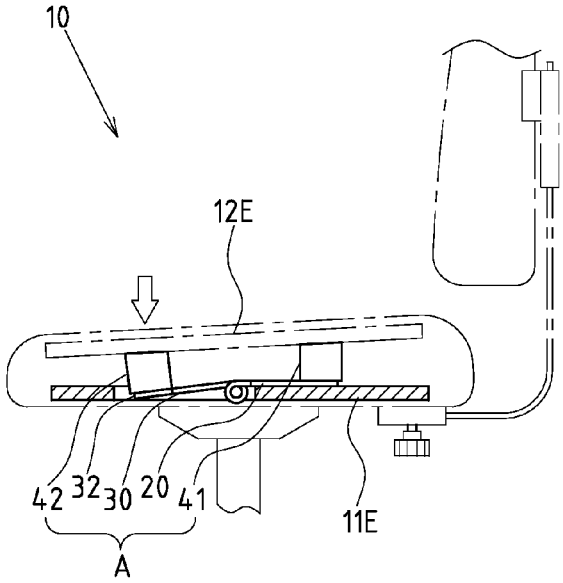
FIG. 11 shows a side sectional view of the seat of the chair of the present invention being the movable part.
Figure 12:
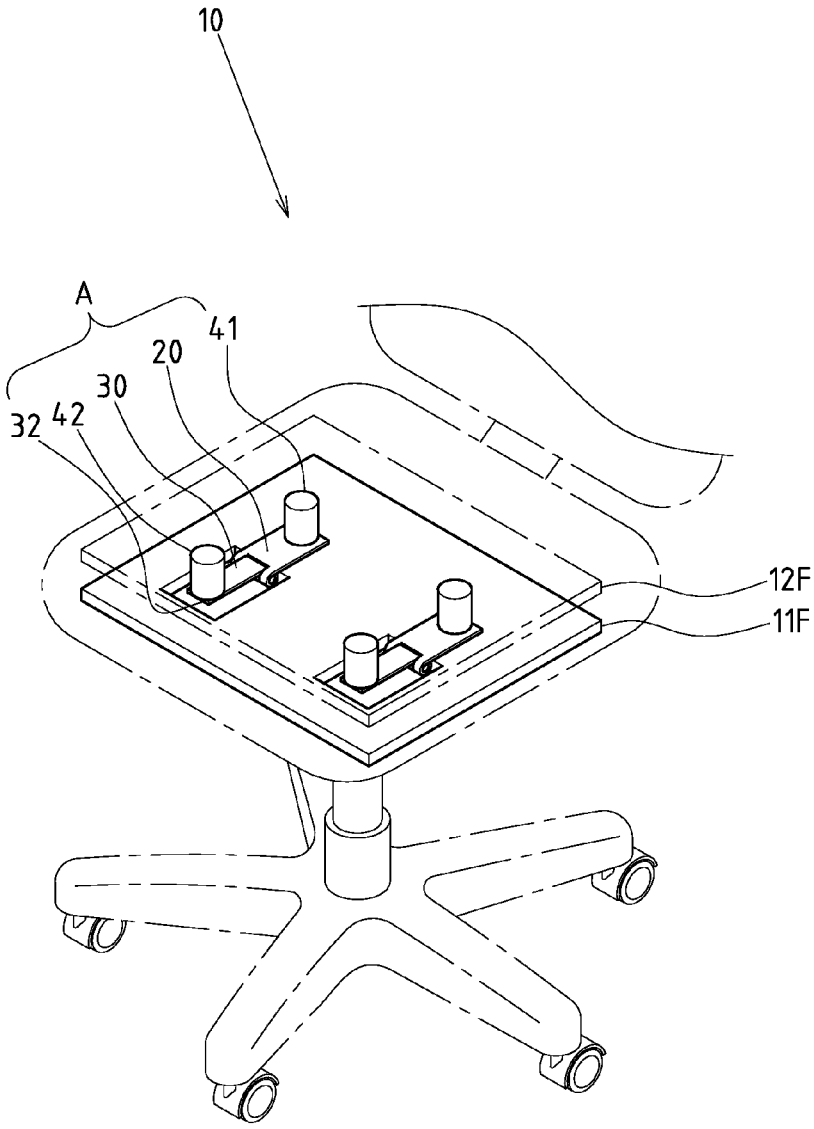
FIG.12 shows an upper perspective view of the seat of the chair of the present invention with a movable part and a positioning part in a single set.

As shown in FIGS. 10 and 11, when the movable part 12E is the seat of the chair, the positioning part 11E is used as supporting frame for movable part 12E. This embodiment uses the swinging feature of the second end 32 of the swing rack 30 of the elastic support structure A to create a greater range of swing (in the direction marked by hollow arrow in FIG. 11) in the corresponding direction, so that it meets the need for human thigh as it pushes down. Moreover, the movable part 12E and the positioning part 11E can be two separate sets in connection (as shown in FIG. 10). Also, the movable part 12E and the positioning part 11F shown in FIG. 12 can be a single set of structure.

In addition, even though the support structure for human body to lean against mentioned above is a chair, the support structure for human body to lean against is not limited to this embodiment. For instance, the support structure of fitness equipment or a motor vehicle also have compatible elements, such as a back of a chair and a seat. Therefore, the elastic support structure A can easily provide the same effects in these other structures and be included in the scope of the present invention.

I claim:

1. A support apparatus for a chair comprising:

a positioning part;

a movable part having a surface thereon suitable for allowing a portion of a human body to lean against; and an elastic support structure positioned between said positioning part and said movable part, said elastic support structure comprising:

a connecting frame having a connecting surface connected to said positioning part;

a swing rack having one end pivotally connected to one end of said connecting frame, said swing rack having a second end;

a first elastic member having a first end affixed to one side of said connecting frame and a second end affixed to said movable part; and a second elastic member having a first end affixed to one side of said second end of said swing rack and a second end affixed to said movable part in spaced relation to said first elastic member.

2. The support apparatus of claim 1, said elastic support structure further comprising:

a bolt axle joining said one end of said swing rack to said one end of said connecting frame such that swing rack is pivotable relative to said connecting frame.

3. The support apparatus of claim 1, said movable part being a back of the chair.

4. The support apparatus of claim 1, each of said swing rack and said connecting frame having a plurality of spaced-apart holes, each of said first and second elastic members being respectively selectively affixed in the plurality of spaced-apart holes.

* * * * *